US010233881B2

(12) United States Patent
Hidaka et al.

(10) Patent No.: US 10,233,881 B2
(45) Date of Patent: Mar. 19, 2019

(54) FUEL PUMP

(71) Applicant: DENSO CORPORATION, Kariya, Aichi-pref. (JP)

(72) Inventors: Yuuji Hidaka, Kariya (JP); Masaya Ootake, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/571,974

(22) PCT Filed: May 19, 2016

(86) PCT No.: PCT/JP2016/002443
§ 371 (c)(1),
(2) Date: Nov. 6, 2017

(87) PCT Pub. No.: WO2016/189836
PCT Pub. Date: Dec. 1, 2016

(65) Prior Publication Data

US 2018/0142653 A1 May 24, 2018

(30) Foreign Application Priority Data

May 28, 2015 (JP) ..... 2015-108657

(51) Int. Cl.

| | |
|---|---|
| ***F02M 37/00*** | (2006.01) |
| ***F02M 37/08*** | (2006.01) |
| ***F02M 37/10*** | (2006.01) |
| ***F04D 5/00*** | (2006.01) |
| ***F04D 13/06*** | (2006.01) |

(Continued)

(52) U.S. Cl.
CPC ..... *F02M 37/08* (2013.01); *F02M 37/045* (2013.01); *F02M 37/10* (2013.01); *F04D 5/00* (2013.01); *F04D 5/002* (2013.01); *F04D 13/06* (2013.01); *F04D 29/188* (2013.01); *F04D 29/20* (2013.01)

(58) Field of Classification Search
CPC ..... F02M 37/08; F02M 37/045; F02M 37/10; F04D 29/188; F04D 29/20; F04D 13/06; F04D 5/002; F04D 5/00
See application file for complete search history.

(56) References Cited

U.S. PATENT DOCUMENTS 4,586,877 A * 5/1986 Watanabe ..... F02M 37/048 415/106
4,854,830 A * 8/1989 Kozawa ..... F02M 37/048 417/365

(Continued)

FOREIGN PATENT DOCUMENTS

JP 2007-146751 6/2007
JP 2013-234630 11/2013

*Primary Examiner* — Hieu T Vo
*Assistant Examiner* — Sherman Manley
(74) *Attorney, Agent, or Firm* — Nixon & Vanderhye P.C.

(57) ABSTRACT

An outer wall surface of an output end portion includes a pair of first plane surfaces which are formed at different positions in its circumferential direction. An inner wall surface of a fitting hole includes a pair of second plane surfaces which are formed at different positions in the circumferential direction. A clearance between one of the pair of first plane surfaces and one of the pair of second plane surfaces is made larger from one side toward the other side in an axial direction in a state that a rotary shaft and an impeller are concentric with each other.

11 Claims, 13 Drawing Sheets

(51) Int. Cl.

| | |
|---|---|
| ***F04D 29/18*** | (2006.01) |
| ***F04D 29/20*** | (2006.01) |
| ***F02M 37/04*** | (2006.01) |

(56) References Cited

U.S. PATENT DOCUMENTS

| | | | | | |
|---|---|---|---|---|---|
| 5,174,713 | A * | 12/1992 | Iwai | F02M 37/048 | 415/55.1 |
| 2003/0118439 | A1* | 6/2003 | Usui | F04D 5/002 | 415/55.1 |
| 2004/0191054 | A1* | 9/2004 | Honda | F04D 5/002 | 415/55.1 |
| 2007/0122264 | A1* | 5/2007 | Nakagawa | F04D 29/0413 | 415/55.1 |
| 2008/0253878 | A1* | 10/2008 | Ikeya | F04D 5/002 | 415/55.2 |
| 2012/0257956 | A1* | 10/2012 | Lee | F02M 37/048 | 415/55.1 |
| 2014/0255199 | A1* | 9/2014 | Honda | F04D 29/18 | 416/231 R |
| 2016/0238016 | A1* | 8/2016 | Sakai | F04D 5/002 | |
| 2016/0369818 | A1* | 12/2016 | Sakai | F04D 29/669 | |

* cited by examiner

FUEL PUMP

This application is the U.S. national phase of International Application No. PCT/JP2016/002443 filed May 19, 2016, which designated the U.S. and claims priority to Japanese Patent Application No. 2015-108657 filed on May 28, 2015, the entire contents of each of which are hereby incorporated herein by reference.

CROSS REFERENCE TO RELATED APPLICATION

This application is based on Japanese Patent Application No. 2015-108657 filed on May 28, 2015, the disclosure of which is incorporated herein by reference.

TECHNICAL FIELD

The present disclosure relates to a fuel pump.

BACKGROUND ART

As disclosed, for example, in Patent Document 1, there has been known a fuel pump provided with a motor, an impeller in which an output end portion of a rotary shaft of the motor is fitted, and a case in which the impeller is received. The case includes a pump chamber, a suction hole which passes through to one end in an axial direction from the pump chamber, and a discharge hole which passes through to the other end in the axial direction from the pump chamber. In this type of fuel pump, fuel in the pump chamber has its pressure raised while the fuel is rotated along with the impeller, whereby the pressure of the fuel is made higher on a discharge hole side than on a suction hole side. For this reason, the pressure applied to the impeller by the fuel is different in a circumferential direction and is different also in the axial direction. Hence, the impeller is rotated in a state where the impeller is inclined.

PRIOR ART DOCUMENT

Patent Document

Patent Document 1: JP 2007-146751A

In Patent Document 1, the output end portion of the rotary shaft of the motor is a D cut shaft which has a plane surface at one portion in the circumferential direction. Further, a fitting hole of the impeller is a D cut hole which has a plane surface at one portion in the circumferential direction. According to a study made by the present inventors, it is found that when the rotary shaft is rotated, the output end portion and the impeller constructed in the manner described above are brought into contact with each other at three portions, thereby restricting their movements each other. Hence, a degree of freedom is not secured in a movement of the impeller to the case, so when the impeller is inclined and is rotated while in contact with the case, the impeller is hard to move in such a way as to relieve its inclination. For this reason, the impeller and the case tend to be easily worn.

SUMMARY OF INVENTION

The present disclosure addresses the above issues. Thus, it is an objective of the present disclosure to provide a fuel pump that can inhibit an impeller and a case from being worn.

To achieve the objective of the present disclosure, a fuel pump in an aspect of the present disclosure includes a motor, an impeller that includes a fitting hole fitted to an output end portion of a rotary shaft of the motor, and a case that includes a pump chamber that receives the impeller, a suction hole that passes through from the pump chamber to one side in an axial direction of the rotary shaft, and a discharge hole that passes through from the pump chamber to the other side in the axial direction. An outer wall surface of the output end portion includes a pair of first plane surfaces which are formed at different positions in its circumferential direction. An inner wall surface of the fitting hole includes a pair of second plane surfaces which are formed at different positions in the circumferential direction. A clearance between one of the pair of first plane surfaces and one of the pair of second plane surfaces is made larger from one side toward the other side in the axial direction in a state that the rotary shaft and the impeller are concentric with each other.

When the rotary shaft is rotated, the output shaft and the impeller constructed in this manner are brought into contact with each other at two portions at least in a half circumference or more. While the output end portion and the impeller are in contact with each other at the two portions, the impeller can move in such a way as to oscillate with respect to the output end portion. For this reason, when the impeller is inclined and is rotated in contact with the case, the impeller can easily move in such a way as to relieve its inclination. Hence, the impeller and the case can be inhibited from being worn.

BRIEF DESCRIPTION OF DRAWINGS

The above and other objects, features and advantages of the present disclosure will become more apparent from the following detailed description made with reference to the accompanying drawings. In the drawings.

EMBODIMENTS FOR CARRYING OUT INVENTION

Hereinafter, a plurality of embodiments will be described on the basis of the drawings. Constructions that are substantially equal to the respective embodiments will be denoted by the same reference signs and their descriptions will be omitted.

(First Embodiment)

Figure 1:
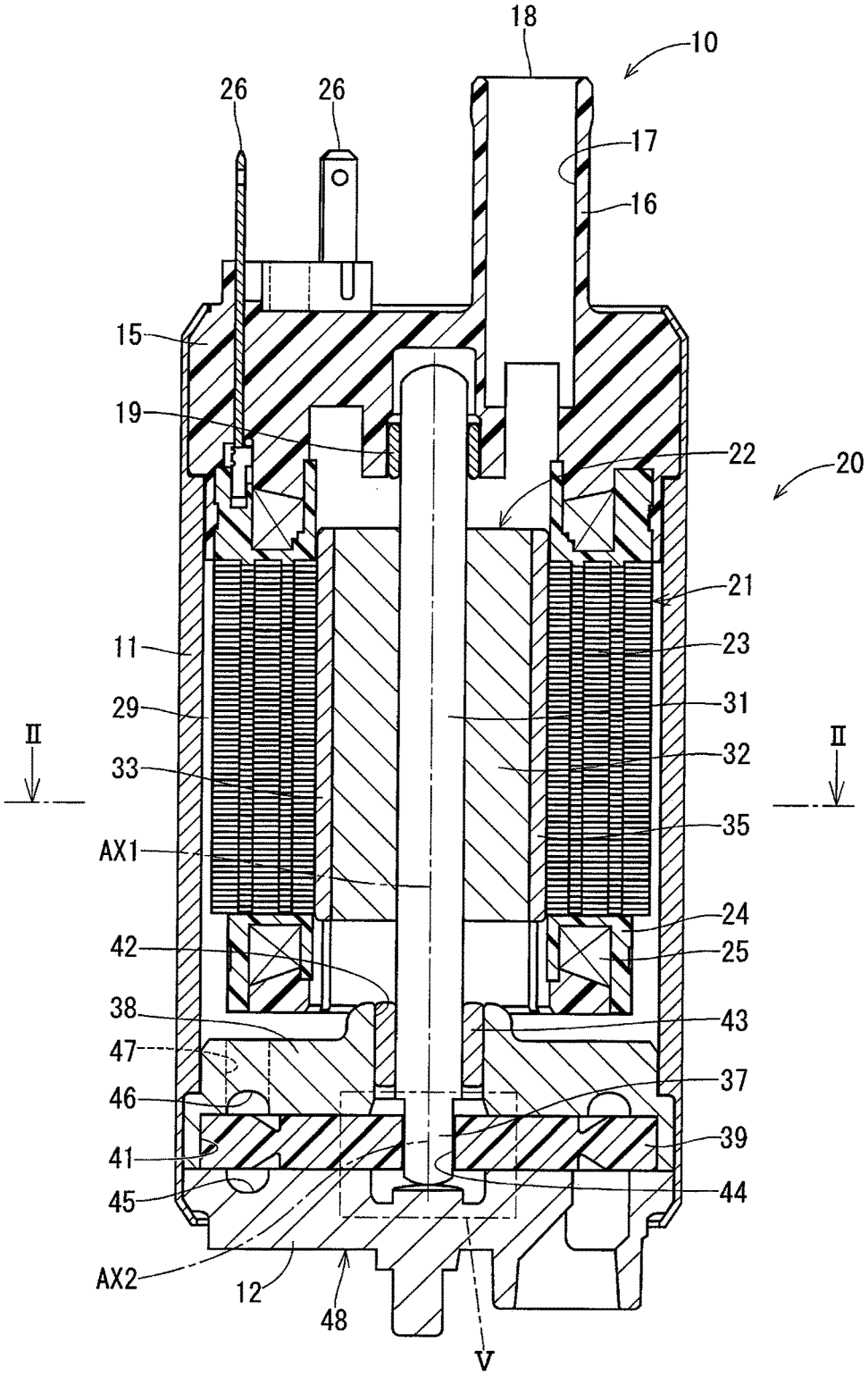
FIG. 1 is a figure to show a longitudinal section of a fuel pump according to a first embodiment.
Figure 8:
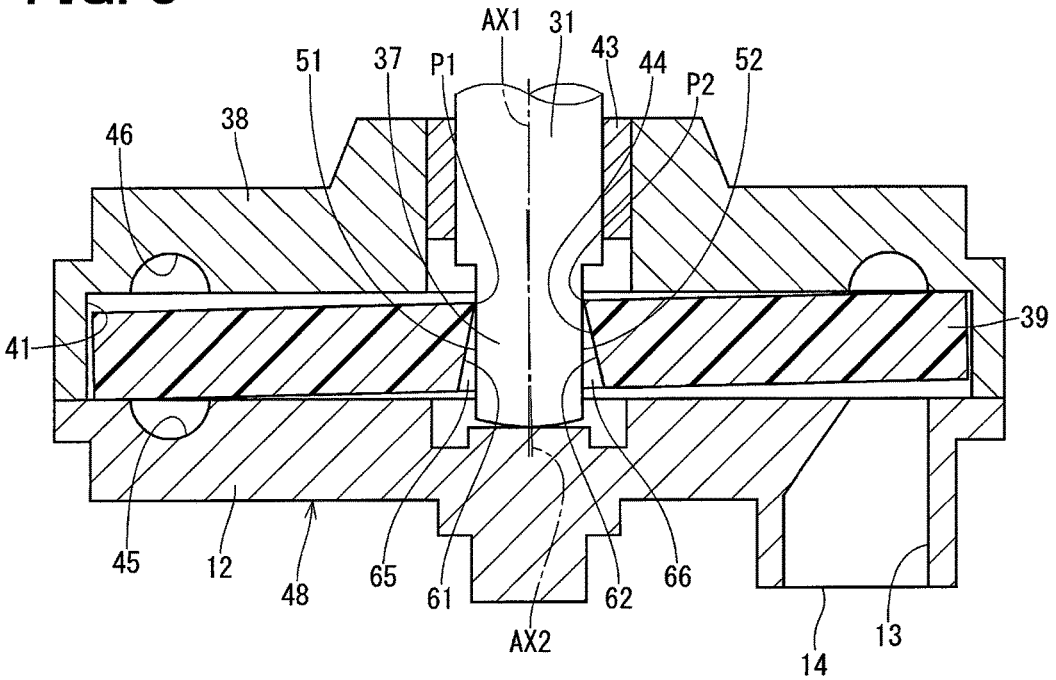
FIG. 8 is a figure to schematically show a pressure raising part of FIG. 1 on an enlarged scale and is a figure to show a state in which an impeller is inclined and is rotated in contact with a case.

A fuel pump according to a first embodiment is an in-tank type pump that is set in a fuel tank of a vehicle and sucks fuel from a suction port 14 shown in a lower portion of FIG. 8 and raises a pressure of the fuel and discharges the fuel to an engine (not shown) from a discharge port 18 shown in an upper portion of FIG. 1.

Figure 2:
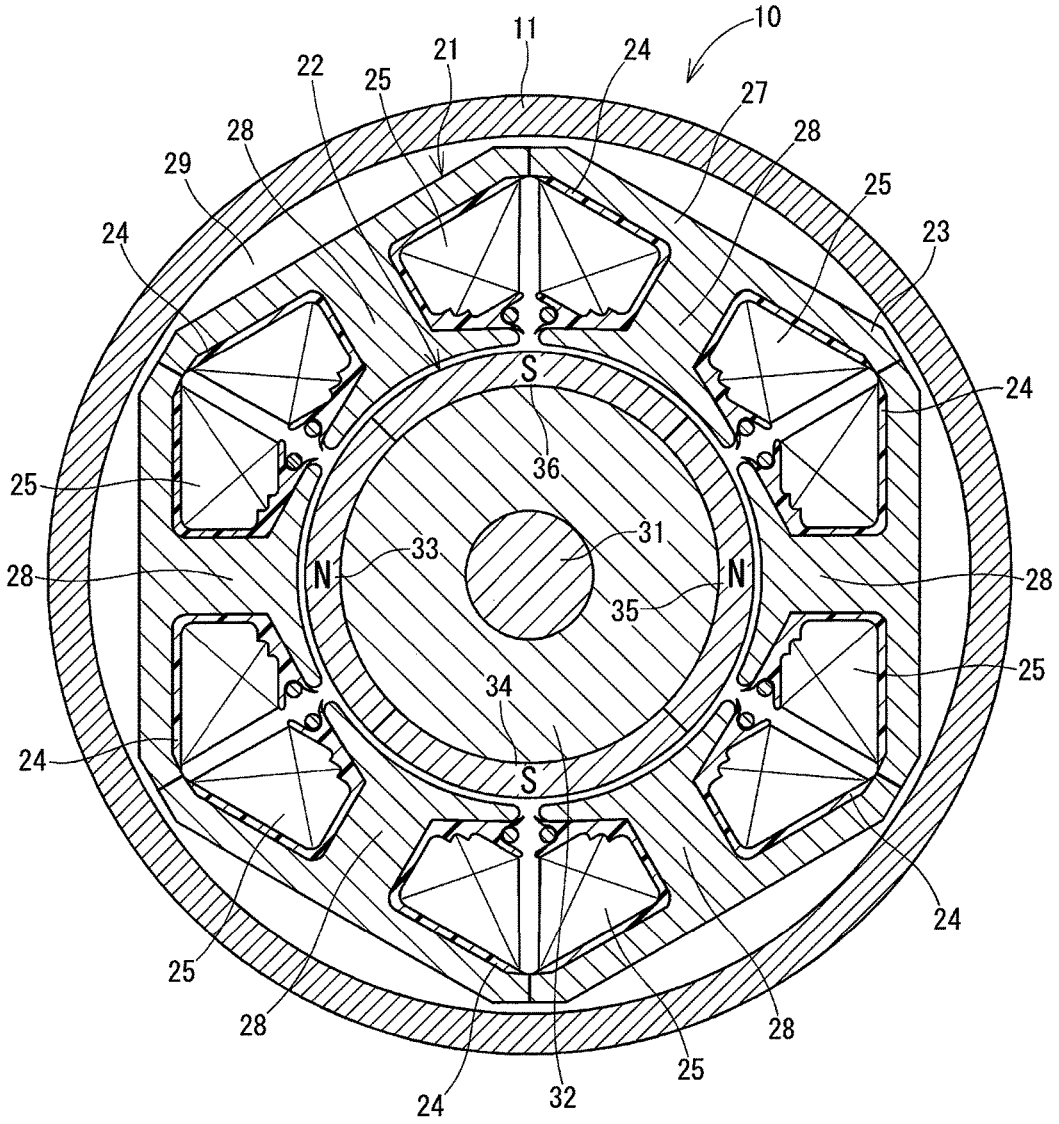
FIG. 2 is a section view taken along a line II-II of FIG. 1.
Figure 3:
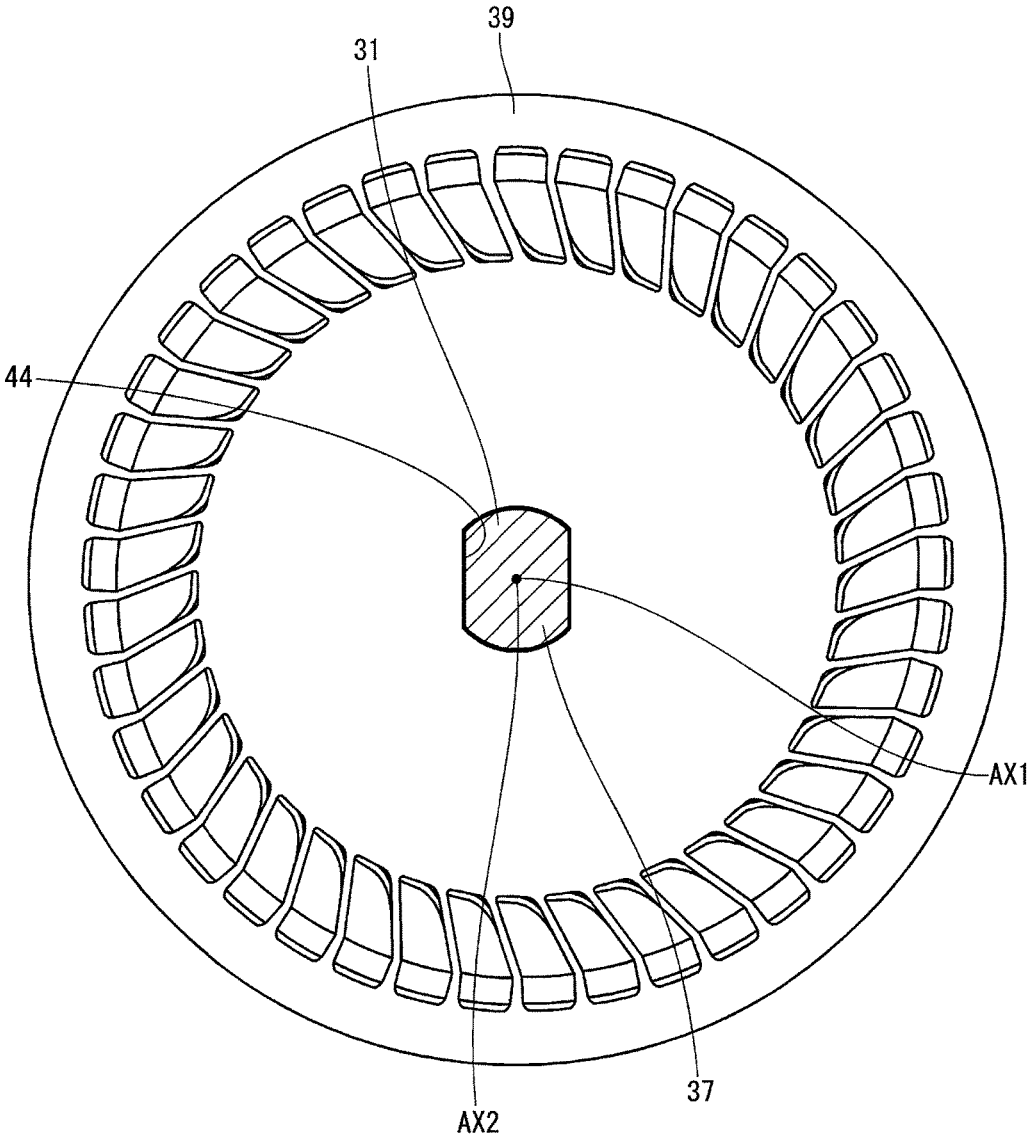
FIG. 3 is a figure to show an impeller of FIG. 1.

Firstly, a general construction of a fuel pump 10 will be described with reference to FIG. 1 to FIG. 3. The fuel pump 10 is roughly divided into an outer part, a drive part, and a pressure raising part. The outer part is constructed of a housing 11, a suction side cover 12, and a discharge side cover 15.

The housing 11 is formed in a cylindrical shape. The suction side cover 12 is provided at one end portion of the housing 11. The suction side cover 12 has a suction hole 13 which passes though in an axial direction. The suction port 14 is an inlet of the suction hole 13. The discharge side cover 15 is provided at the other end portion of the housing 11. The discharge side cover 15 forms a cylinder part 16 which projects to the outside of the housing 11 and has a discharge flow passage 17 which is formed inside the cylinder part 16. The discharge port 18 is an outlet of the discharge flow passage 17. The discharge side cover 15 has a bearing 19 which is provided in a central portion thereof.

The drive part is constructed of a motor 20 and is provided with a stator 21 and a rotor 22. The stator 21 is provided in the housing 11 and includes a stator core 23, an insulator 24, a winding 25, and a terminal 26. The stator core 23 is made of a magnetic material and forms a cylindrical yoke part 27 and a plurality of teeth parts 28 each of which projects inside in a radial direction from the yoke part 27. The insulator 24 is fitted to the teeth part 28 of the stator core 23. The winding 25 is wound by the insulator 24. In the present embodiment, the winding 25 includes a U-phase winding part, a V-phase winding part, and a W-phase winding part. There are provided three terminals 26 and each of the three terminals 26 can couple the winding part of each phase to an external control device.

A fuel flow passage 29 is formed between the housing 11 and the stator 21. The discharge side cover 15 has a fuel flow passage (not shown in the drawing) that connects the fuel flow passage 29 to the discharge flow passage 17. The rotor 22 is provided inside the stator 21 and has a rotary shaft 31, a rotor core 32, and a plurality of magnets 33 to 36. The rotary shaft 31 is supported by the bearing 19 and a bearing 43, which will be described later, in such a way as to rotate. The rotor core 32 is formed in a cylindrical shape and is fitted and fixed to the rotary shaft 31. The magnets 33 to 36 are provided in an outer peripheral portion of the rotor core 32. The respective magnets 33 to 36 are provided in such a way that polarities outside in a radial direction are different from each other in a circumferential direction.

In the motor 20 constructed in this manner, when electric currents each having a phase difference flow through the winding parts of the respective phases of the winding 25 of the stator 21, a rotating magnetic field is generated and the rotating magnetic field attracts magnetic poles of the rotor 22, whereby the rotor 22 is rotated.

The pressure raising part includes a casing 38, an impeller 39, and the suction side cover 12. The suction side cover 12 constructs the outer part of the fuel pump 10 and constructs also the pressure raising part. The casing 38 is formed in a shape of a cylinder having a closed end, is interposed between the stator 21 and the suction side cover 12 and is combined with the suction side cover 12. Further, the casing 38 forms a pump chamber 41 between itself and the suction side cover 12. The casing 38 has a through hole 42 formed in a central portion thereof. The through hole 42 has a bearing 43 fitted therein. An output end portion 37 of the rotary shaft 31 passes through the bearing 43 and protrudes into the pump chamber 41.

The impeller 39 is an impeller shaped like a circular disk and is received in the pump chamber 41. The impeller 39 has a fitting hole 44 formed in a central portion thereof. The fitting hole 44 is fitted on the output end portion 37 of the rotary shaft 31 in such a way as to be able to transmit rotation from the rotary shaft 31 to the impeller 39.

In a wall portion opposite to the impeller 39 of the suction side cover 12, a suction side pressure raising flow passage 45 is formed which is extended in a circumferential direction and which is shaped like a letter C. The suction hole 13 communicates with an upstream side end portion, which is located at an end portion opposite to a rotational direction of the impeller 39, of the suction side pressure raising flow passage 45. In a wall portion opposite to the impeller 39 of the casing 38, a discharge side pressure raising flow passage 46 is formed which is extended in the circumferential direction and which is shaped like a letter C. The casing 38 has a discharge hole 47 communicating with a downstream side end portion, which is located at an end portion in the rotational direction, of the discharge side pressure raising flow passage 46. The suction hole 13 is a hole passing through from the pump chamber 41 to one side in an axial direction, whereas the discharge hole 47 is a hole passing through from the pump chamber 41 to the other side in the axial direction. The casing 38 and the suction side cover 12 constructs a case 48.

In the pressure raising part constructed in this manner, when the impeller 39 is rotated along with the rotary shaft 31, the fuel is sucked into the pump chamber 41 through the suction hole 13 from the suction port 14. The fuel in the pump chamber 41 flows in a shape of a spiral between the impeller 39 and the pressure raising flow passages 45, 46 and has its pressure raised toward the discharge hole 47 from the suction hole 13. The fuel having a pressure raised is introduced into the discharge flow passage 17 through the discharge hole 47 and the fuel flow passage 29 and then is discharged from the discharge port 18.

Next, a characteristic construction of the fuel pump 10 will be described with reference to FIG. 1 and FIG. 4 to FIG. 8. Here, in FIG. 4 to FIG. 8, the construction will be schematically shown so as to make the construction easy to understand. A dimension, an angle, and a dimensional ratio of each part shown in the drawings will be not necessarily correct.

Here, a study made by the present inventors will be described. According to the study made by the present inventors, in a state where an output end portion of a rotary shaft is a D cut shaft and where a fitting hole is a D cut hole, when the rotary shaft is rotated, the output end portion and the impeller are brought into contact with each other at three points to thereby restrict their respective movements. Hence, a movement of the impeller to the case does not have a degree of freedom, so when the impeller is inclined and is rotated in contact with the case, the impeller is hard to move in such a way as to relieve its inclination. For this reason, the impeller and the case are easily worn.

Figure 4:
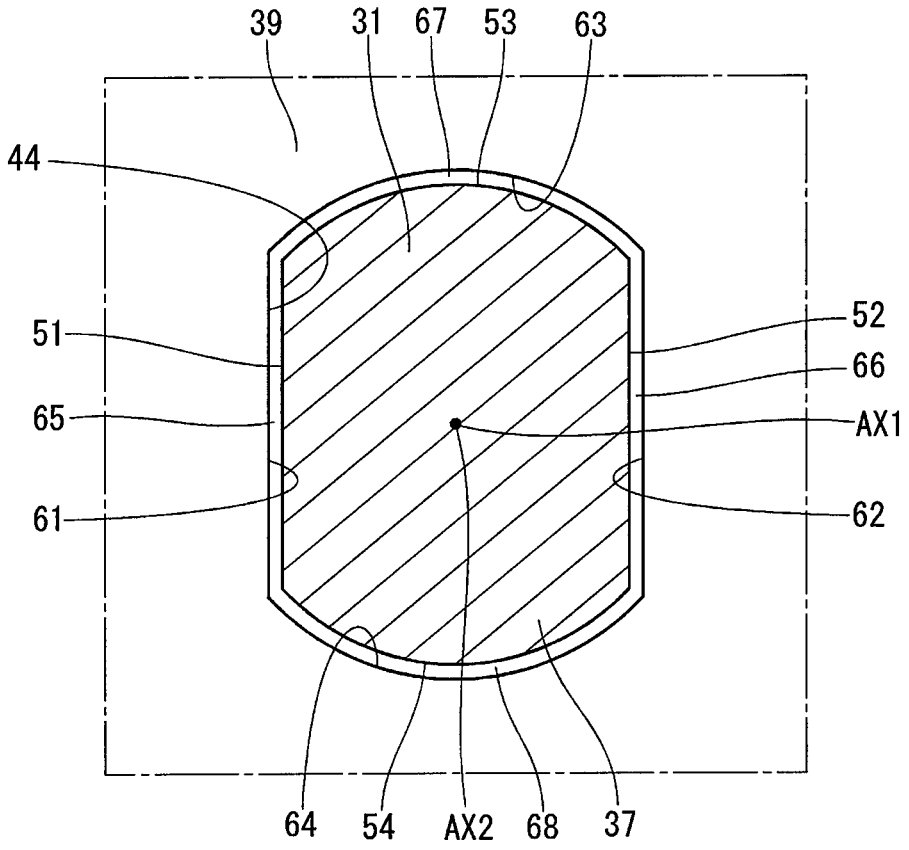
FIG. 4 is an enlarged view of a fitting hole of the impeller of FIG. 3.
Figure 5:
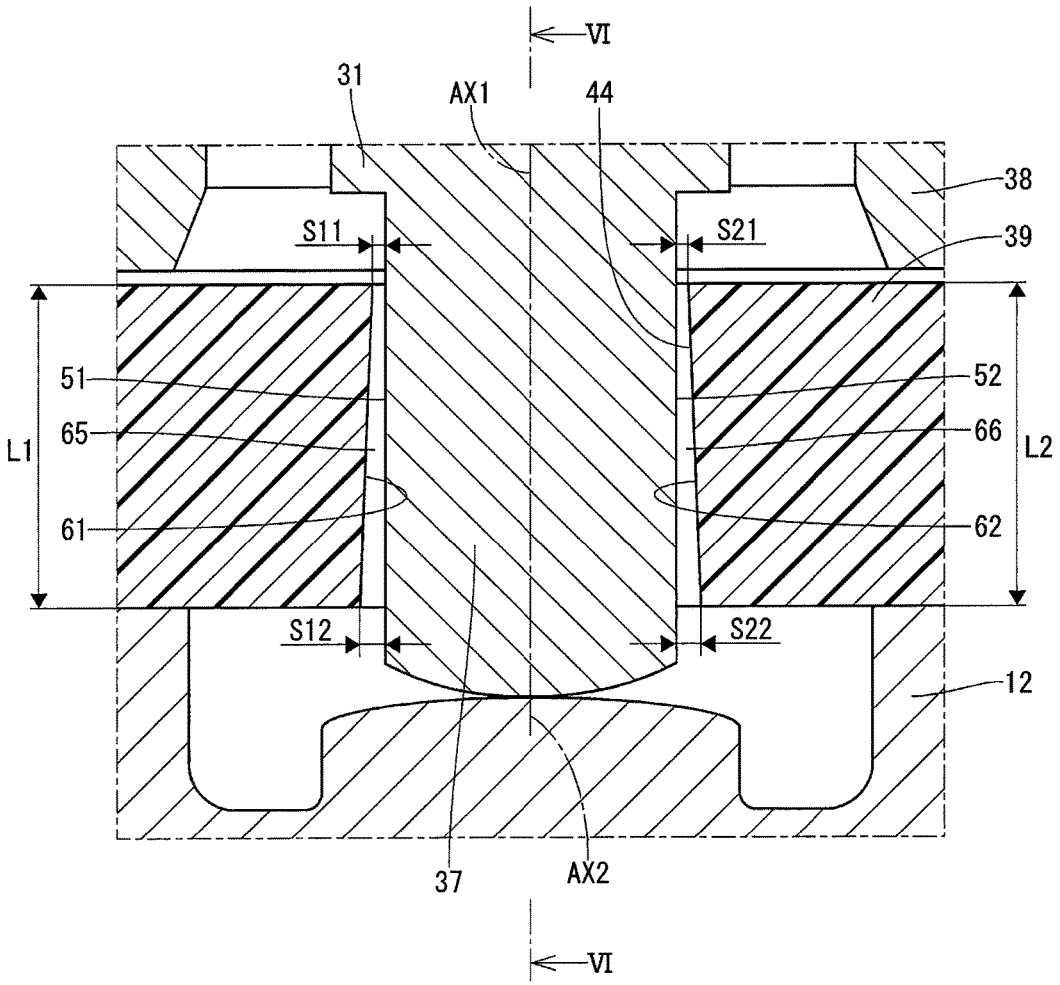
FIG. 5 is an enlarged view of a V portion of FIG. 1.
Figure 6:
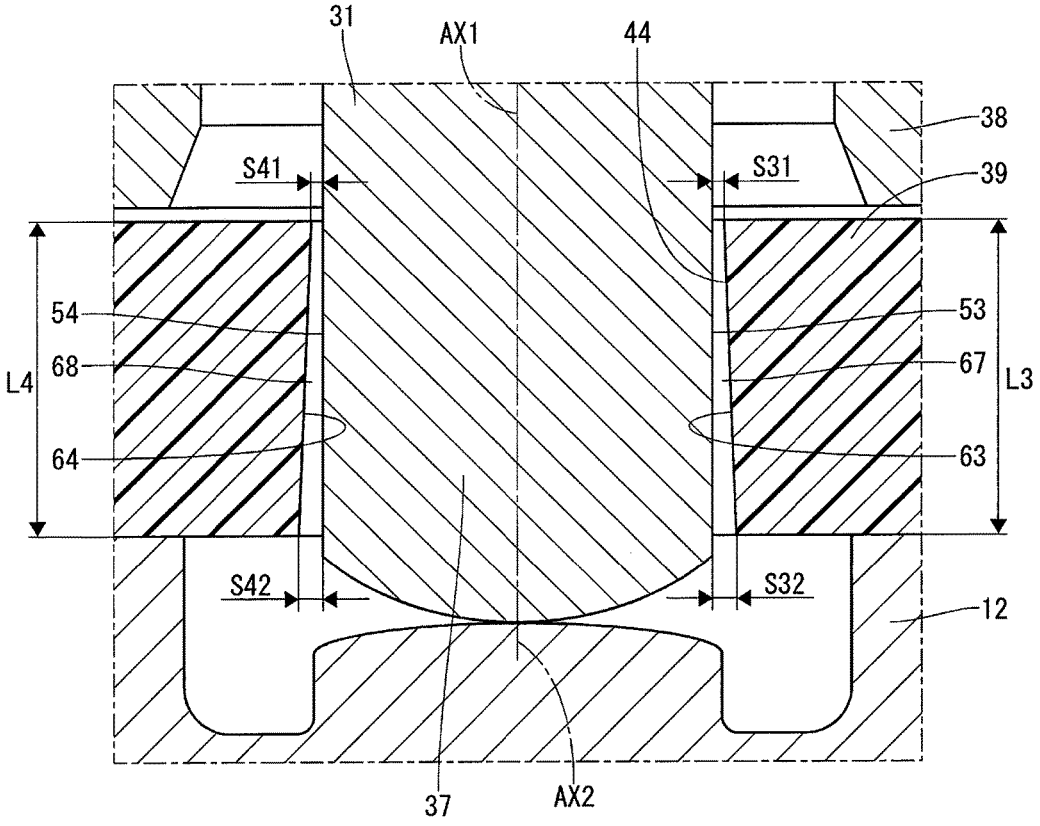
FIG. 6 is a section view taken along a line VI-VI of FIG. 5.

In consideration of this result of the study, for the purpose of increasing a degree of freedom of a movement of the impeller 39 to the case 48 to thereby inhibit the impeller 39 from sliding on the case 48, the following construction is employed for the fuel pump 10. As shown in FIG. 4 to FIG. 6, an outer wall surface of the output end portion 37 includes a pair of first plane surfaces 51, 52 which are formed at two different portions in the circumferential direction, that is, at two portions between which an axial center AX1 of the rotary shaft 31 is located. In the first embodiment, both of the first plane surfaces 51, 52 are parallel to the axial center AX1. Further, the first plane surface 51 is parallel to the second plane surface 52.

Further, the outer wall surface of the output end portion 37 includes a pair of first curved surfaces 53, 54 each of which is located between one first plane surface 51 and the other first plane surface 52 in the circumferential direction and each of which is protruded outwardly in the radial direction. In the first embodiment, a center of curvature of each of the first curved surfaces 53, 54 coincides with the axial center AX1. Further, a radius of the first curved surface 53 is equal to a radius of the first curved surface 54, that is to say, the first curved surface 53 and the first curved surface 54 are formed in such a way as to be along an imaginary cylindrical surface whose center is the axial center AX1. In other words, the output end portion 37 is a shaft which has the pair of first plane surfaces 51, 52 parallel to each other, that is, which is chamfered at two surfaces. The shaft which is chamfered at two surfaces is also referred to as an I-cut shaft or a double D-cut shaft.

An inner wall surface of the fitting hole 44 includes a pair of second plane surfaces 61, 62 which are formed at two different portions in the circumferential direction, that is, at two portions between which the axial center AX1 of the rotary shaft 31 is located. The second plane surface 61 is opposed to the first plane surface 51 in the radial direction and when the rotary shaft 31 is rotated, the second plane surface 61 is engaged with the first plane surface 51. Further, the second plane surface 61 is inclined to the first plane surface 51. The second plane surface 62 is opposed to the first plane surface 52 in the radial direction and when the rotary shaft 31 is rotated, the second plane surface 62 is engaged with the first plane surface 52. Still further, the second plane surface 62 is inclined to the first plane surface 52.

Further, the inner wall surface of the fitting hole 44 includes a pair of second curved surfaces 63, 64 each of which is located between one second plane surface 61 and the other second plane surface 62 in the circumferential direction and each of which is depressed outwardly in the radial direction. The second curved surfaces 63, 64 are formed in such a way as to be along an imaginary conical surface whose center is an axial center AX2. The second curved surface 63 is opposed to the first curved surface 53 in the radial direction and is inclined to the first curved surface 53. The second curved surface 64 is opposed to the first curved surface 54 in the radial direction and is inclined to the first curved surface 54.

Hereinafter, a clearance between the one first plane surface 51 and the one second plane surface 61 is referred to as a first clearance 65, whereas a clearance between the other first plane surface 52 and the other second plane surface 62 is referred to as a second clearance 66. Further, a clearance between the one first curved surface 53 and the one second curved surface 63 is referred to as a third clearance 67, whereas a clearance between the other first curved surface 54 and the other second curved surface 64 is referred to as a fourth clearance 68.

As shown in FIG. 5, each of the first clearance 65 and the second clearance 66 is made larger from one side to the other side in the axial direction in a state where the rotary shaft 31 and the impeller 39 are concentric with each other. In the first embodiment, the one side in the axial direction means a discharge hole 47 side for the impeller 39, whereas the other side in the axial direction means a suction hole 13 side for the impeller 39.

When it is assumed that, in the state where the rotary shaft 31 and the impeller 39 are concentric with each other, an interval at an end on the one side in the axial direction of the first clearance 65 is S11 and an interval at an end on the other side in the axial direction of the first clearance 65 is S12 and that a length in the axial direction of the first clearance 65 is L1, dimensions of the respective portions are set in such a way as to satisfy the following expression (1).

$$(S12-S11)/L1 \geq 0.0055 \quad (1)$$

When it is assumed that, in the state where the rotary shaft 31 and the impeller 39 are concentric with each other, an interval at an end on the one side in the axial direction of the second clearance 66 is S21 and an interval at an end on the other side in the axial direction of the second clearance 66 is S22 and that a length in the axial direction of the second clearance 66 is L2, dimensions of the respective portions are set in such a way as to satisfy the following expression (2).

$$(S22-S21)/L2 \geq 0.0055 \quad (2)$$

As shown in FIG. 6, each of the third clearance 67 and the fourth clearance 68 is made larger from the one side to the other side in the axial direction in the state where the rotary shaft 31 and the impeller 39 are concentric with each other.

When it is assumed that, in the state where the rotary shaft 31 and the impeller 39 are concentric with each other, an interval at an end on the one side in the axial direction of the third clearance 67 is S31 and an interval at an end on the other side in the axial direction of the third clearance 67 is S32 and that a length in the axial direction of the third clearance 67 is L3, dimensions of the respective portions are set in such a way as to satisfy the following expression (3).

$$(S32-S31)/L3 \geq 0.0055 \quad (3)$$

When it is assumed that, in the state where the rotary shaft 31 and the impeller 39 are concentric with each other, an interval at an end on the one side in the axial direction of the fourth clearance 68 is S41 and an interval at an end on the other side in the axial direction of the fourth clearance 68 is S42 and that a length in the axial direction of the fourth clearance 68 is L4, dimensions of the respective portions are set in such a way as to satisfy the is following expression (4).

$$(S42-S41)/L4 \geq 0.0055 \quad (4)$$

Figure 7:
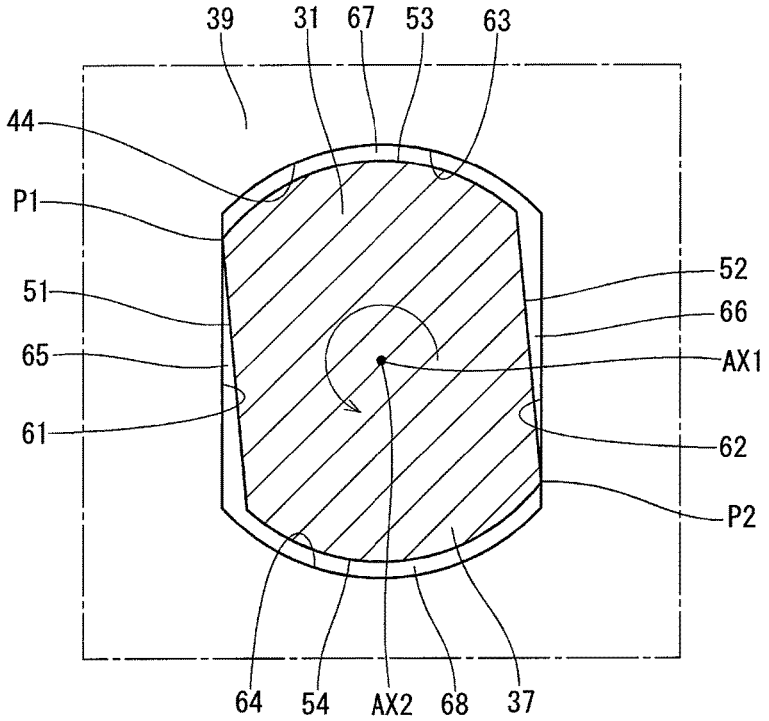
FIG. 7 is an enlarged view of a fitting hole of the impeller of FIG. 3 and is a figure to show a state in which an output end portion of a rotary shaft and the impeller are rotated in contact with each other at two points.

In the fuel pump 10 constructed in this manner, when the rotary shaft 31 is rotated, the output end portion 37 and the impeller 39 are brought into contact with each other at two portions. As shown in FIG. 7 and FIG. 8, contact portions P1, P2 are located at positions in which the clearances 65, 66 are narrow, that is, on the discharge hole 47 side in the axial direction. While the impeller 39 is in contact with the output end portion 37 at two portions, the impeller 39 can move in such a way as to oscillate with respect to the output end portion 37. Coupling of the output end portion 37 and the impeller 39 forms a floating structure by two-point contact. For this reason, as shown in FIG. 8, when the impeller 39 is inclined and is rotated in contact with the case 48, the impeller 39 receives a reaction force from the case 48 and hence can move in such a way as to relieve a degree of inclination.

Effects of the fuel pump 10 of the first embodiment will be described in the following. As described above, in the first embodiment, the outer wall surface of the output end portion 37 includes the pair of first plane surfaces 51, 52 which are formed at different portions in the circumferential direction. The inner wall surface of the fitting hole 44 includes the pair of second plane surfaces 61, 62 which are formed at different portions in the circumferential direction. The first clearance 65 between the one first plane surface 51 and the one second plane surface 61 is made larger from the one side to the other side in the axial direction in the state where the rotary shaft 31 and the impeller 39 are concentric with each other.

When the rotary shaft 31 is rotated, the output end portion 37 and the impeller 39 are brought into contact with each other at two portions at least in a half circumference or more. While the impeller 39 is in contact with the output end portion 37 at the two portions, the impeller 39 can move in such a way as to oscillate with respect to the output end portion 37. For this reason, when the impeller 39 is inclined and is rotated in contact with the case 48, the impeller 39 receives a reaction force from the case 48 and hence can easily move in such a way as to relieve a degree of inclination. Hence, it is possible to inhibit the impeller 39 and the case 48 from being worn. Further, it is possible to reduce vibrations and noises caused when the impeller 39 and the case 48 are brought into contact with each other.

Further, in the first embodiment, the second clearance 66 between the other first plane surface 52 and the other second plane surface 62, which is opposite to the other first plane surface 52, is made larger from the one side to the other side in the axial direction in the state where the rotary shaft 31 and the impeller 39 are concentric with each other. When the rotary shaft 31 is rotated, the output end portion 37 and the impeller 39 which are formed in this manner are bought into contact with each other at two portions in the nearly whole circumference. For this reason, the impeller 39 can easily move in such a way as to more relieve the degree of inclination.

Still further, in the first embodiment, an angle at which the first plane surface 51 is inclined to the second plane surface 61 and an angle at which the first plane surface 52 is inclined to the second plane surface 62 are set in such a way as to satisfy the expressions (1), (2) described above. For this reason, even in a case where each of the rotary shaft 31 and the impeller 39 is formed in a smaller dimension within a tolerance, where each of the pump chamber 41 and the fitting hole 44 is formed in a larger dimension within a tolerance and where the rotary shaft 31 and the impeller 39 are inclined to a maximum limit, a space can be surely ensured on the other side in the axial direction between the first plane surface 51 and the second plane surface 61 and on the other side in the axial direction between the first plane surface 52 and the second plane surface 62.

Still further, in the first embodiment, the third clearance 67 between the one first curved surface 53 and the one second curved surface 63 is made larger from the one side to the other side in the axial direction in the state where the rotary shaft 31 and the impeller 39 are concentric with each other. Still further, the fourth clearance 68 between the other first curved surface 54 and the other second curved surface 64, which is opposite to the other first curved surface 54, is made larger from the one side to the other side in the axial direction in the state where the rotary shaft 31 and the impeller 39 are concentric with each other. For this reason, it is possible to inhibit the oscillation of the impeller 39 from being impeded by contact between the first curved surface 53 and the second curved surface 63 and by contact between the first curved surface 54 and the second curved surface 64.

Still further, in the first embodiment, both of the first plane surfaces 51, 52 are parallel to the axial center AX1 of the rotary shaft 31. For this reason, when the first plane surfaces 51, 52 are formed by machining, they can be easily machined.

(Second Embodiment)

Figure 9:
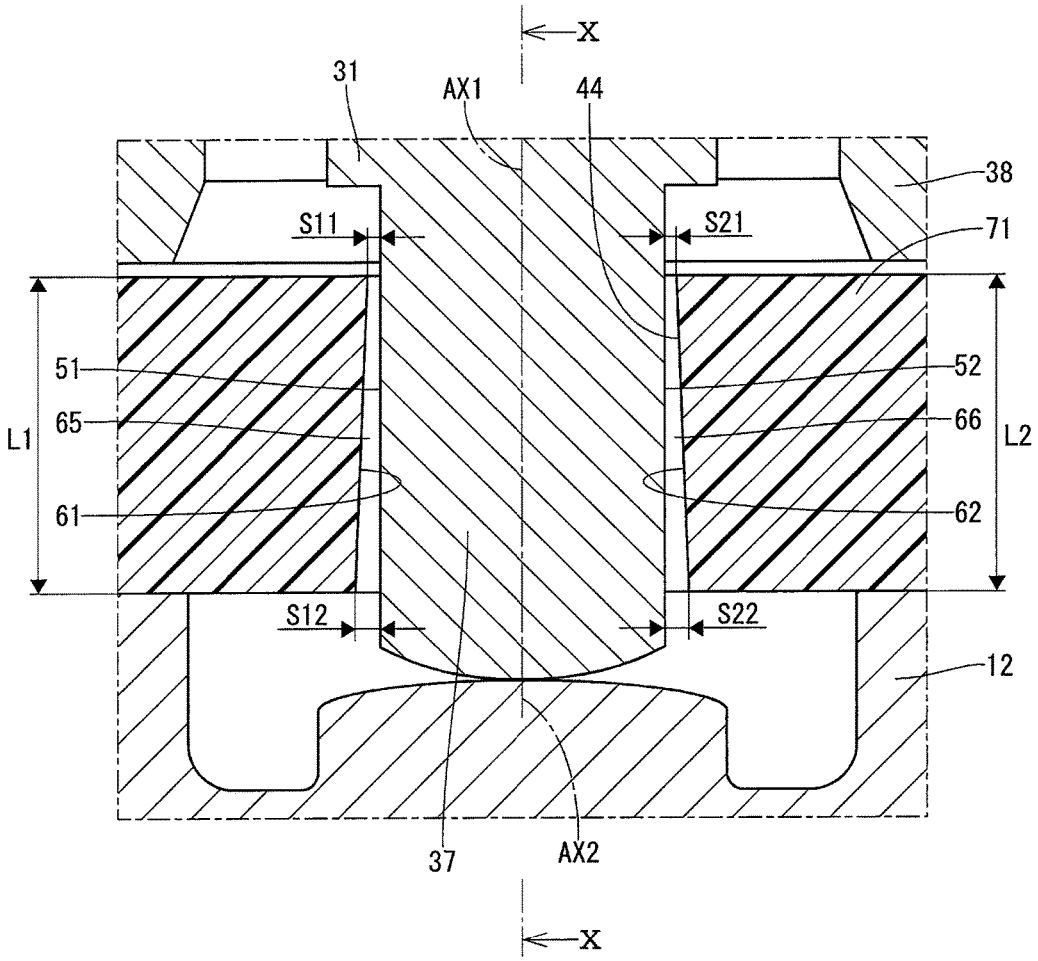
FIG. 9 is a figure to show a portion in which an output end portion of a rotary shaft is fitted in an impeller, on an enlarged scale, of a fuel pump according to a second embodiment.

In a second embodiment, as shown in FIG. 9, each of the first clearance 65 and the second clearance 66 is made larger from one side to the other side in the axial direction, as is the case with the first embodiment, in the state where the rotary shaft 31 and an impeller 71 are concentric with each other.

Figure 10:
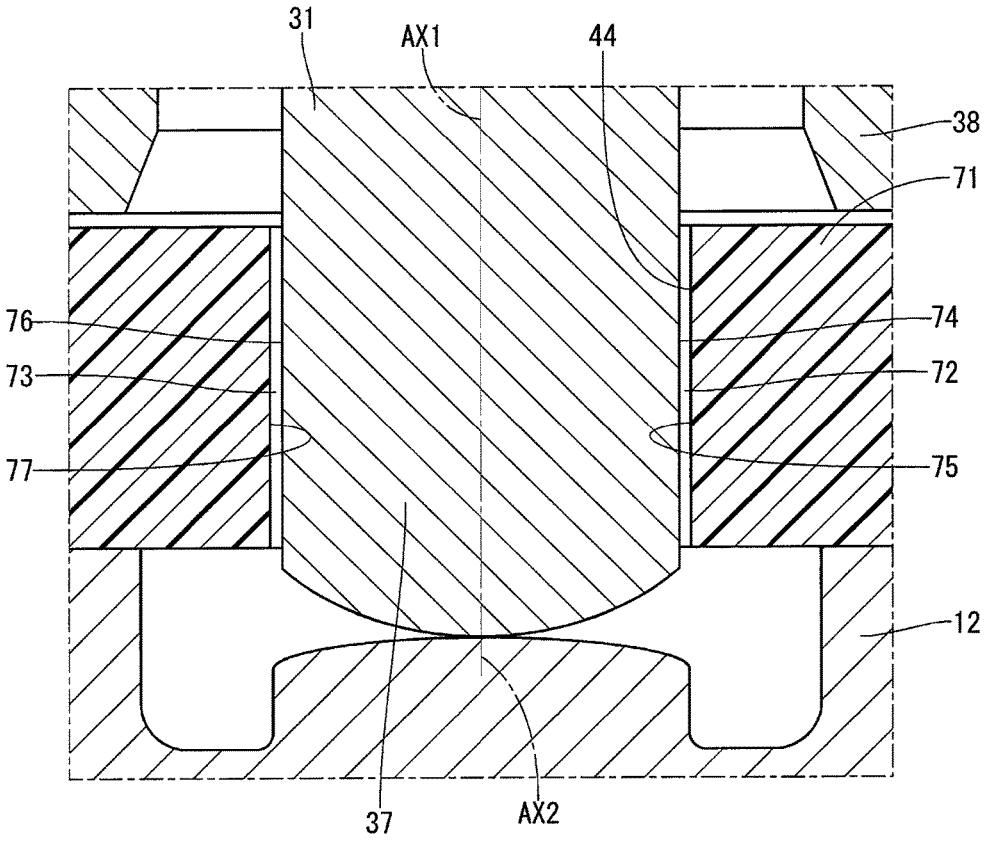
FIG. 10 is a section view taken along a line X-X of FIG. 9.

On the other hand, as shown in FIG. 10, each of a third clearance 72 and a fourth clearance 73 is not changed from one side to the other side in the axial direction in a state where the rotary shaft 31 and the impeller 71 are concentric with each other. In other words, each of a distance between one first curved surface 74 and one second curved surface 75 and a distance between the other first curved surface 76 and the other second curved surface 77 is constant in the axial direction. A center of curvature of each of the second curved surfaces 75, 77 coincides with an axial center AX2, and a radius of the second curved surface 75 is equal to a radius of the second curved surface 77. In other words, the second curved surface 75 and the second curved surface 77 are formed in such a way as to be along an imaginary cylindrical surface whose center is the axial center AX2.

Even in a case where only the first clearance 65 and the second clearance 66 are made larger in this manner from the one side to the other side in the axial direction, as compared with a state where each of dimensions of the first clearance to the fourth clearance is constant in the axial direction, the impeller 71 can easily move in such a way as to relieve its inclination.

(Third Embodiment)

Figure 11:
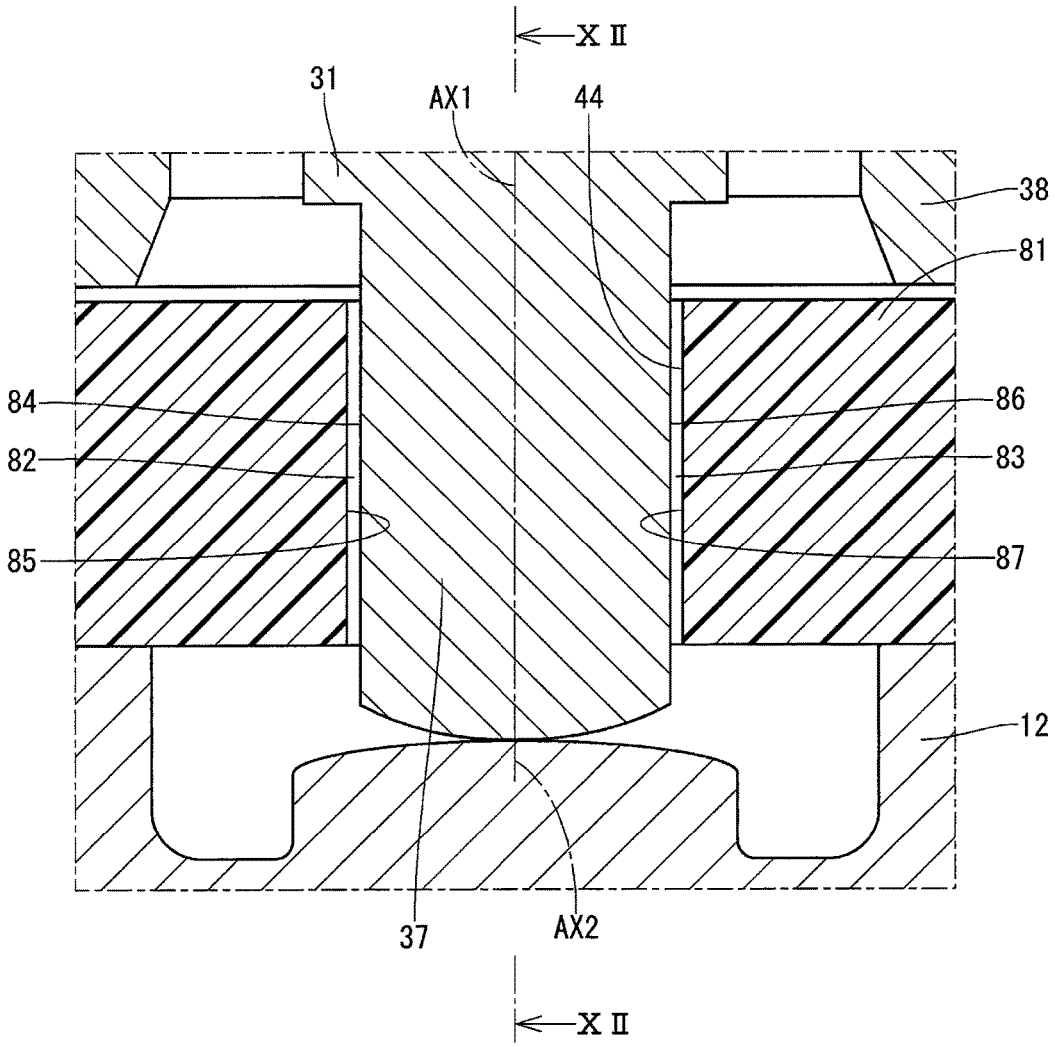
FIG. 11 is a figure to show a portion in which an output end portion of a rotary shaft is fitted in an impeller, on an enlarged scale, of a fuel pump according to a third embodiment.

In a third embodiment, as shown in FIG. 11, each of a first clearance 82 and a second clearance 83 is not changed from one side to the other side in the axial direction in a state where the rotary shaft 31 and an impeller 81 are concentric with each other. In other words, each of a distance between one first plane surface 84 and one second plane surface 85 and a distance between the other first plane surface 86 and the other second plane surface 87 is constant in the axial direction. Both of the second plane surfaces 85, 87 are parallel to an axial center AX2 of the impeller 81.

Figure 12:
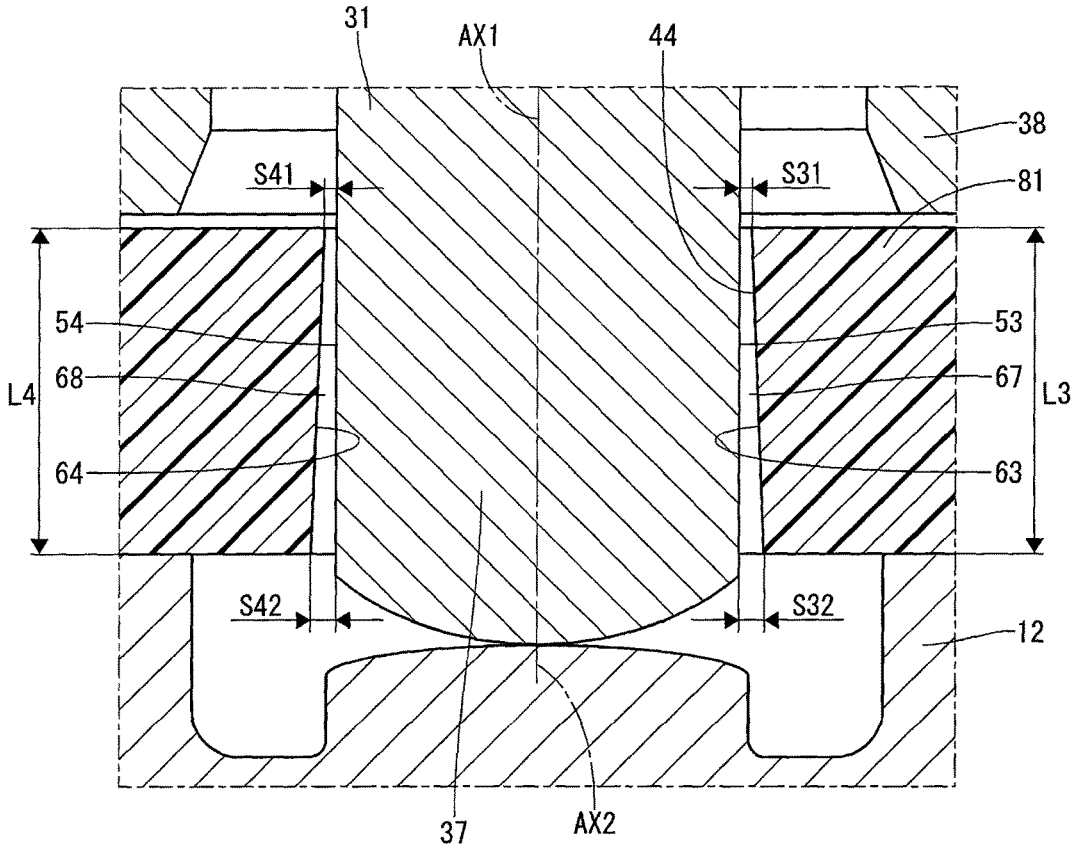
FIG. 12 is a section view taken along a line XII-XII of FIG. 11.

On the other hand, as shown in FIG. 12, each of the third clearance 67 and the fourth clearance 68 is made larger from one side to the other side in the axial direction, as is the case with the first embodiment, in a state where the rotary shaft 31 and the impeller 81 are concentric with each other.

Even in a case where only the third clearance 67 and the fourth clearance 68 are made larger from the one side to the other side in the axial direction, as compared with a state where each of dimensions of the first clearance to the fourth clearance is constant in the axial direction, the impeller 81 can easily move in such a way as to relieve its inclination.

(Fourth Embodiment)

Figure 13:
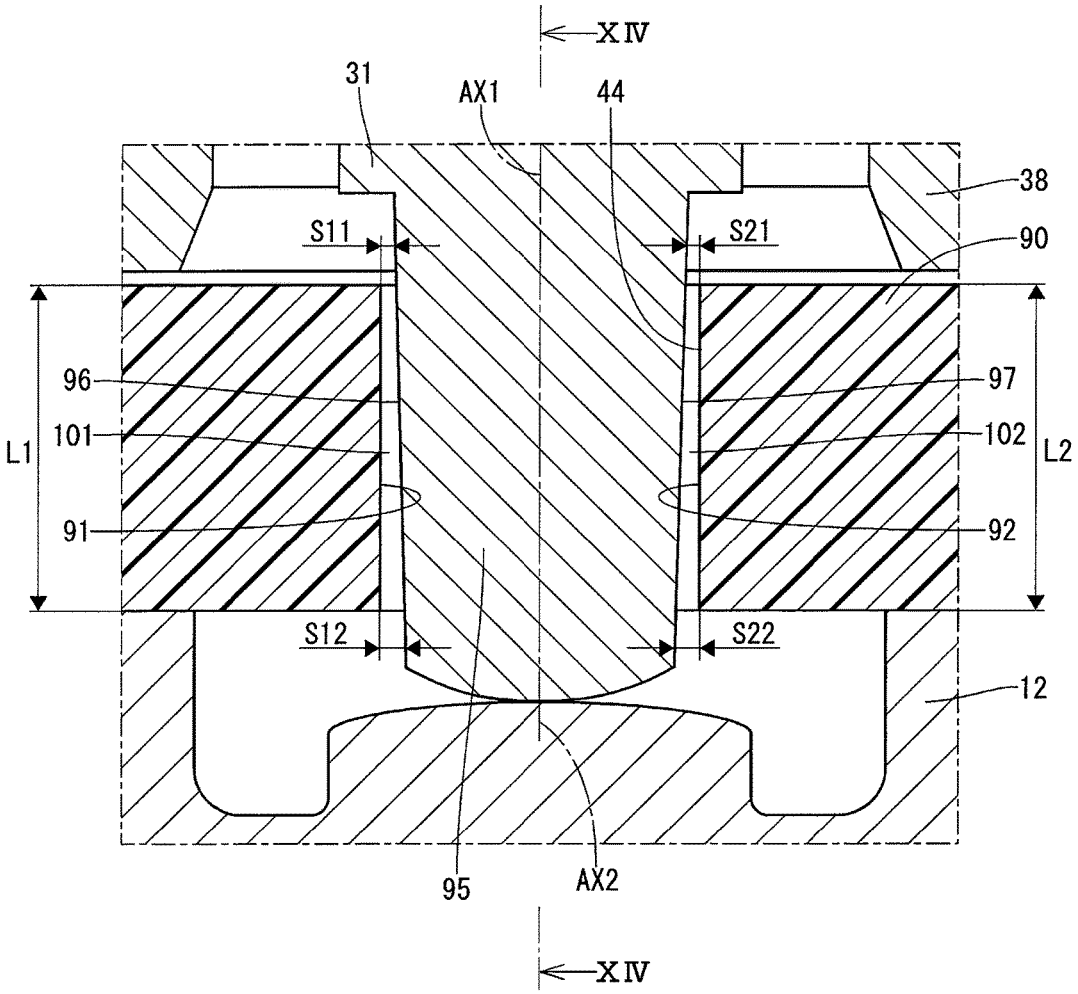
FIG. 13 is a figure to show a portion in which an output end portion of a rotary shaft is fitted in an impeller, on an enlarged scale, of a fuel pump according to a fourth embodiment.
Figure 14:
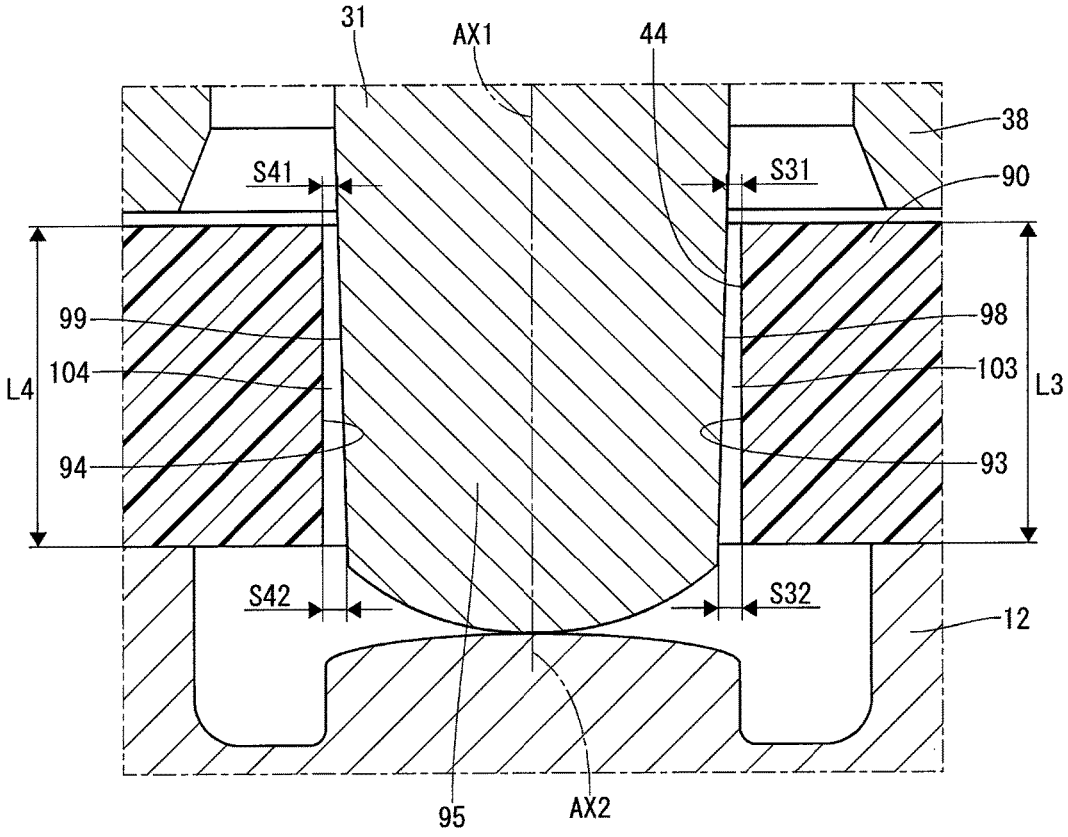
FIG. 14 is a section view taken along a line XIV-XIV of FIG. 13.

In a fourth embodiment, as shown in FIG. 13, each of second plane surfaces 91, 92 of an impeller 90 is parallel to the axial center AX2. Further, as shown in FIG. 14, a center of curvature of each of second curved surfaces 93, 94 of the impeller 90 coincides with the axial center AX2. In other words, the second curved surfaces 93, 94 are formed in such a way as to be along an imaginary cylindrical surface whose center is the axial center AX2.

On the other hand, as shown in FIG. 13, a first plane surface 96 of an output end portion 95 is inclined to a second plane surface 91 which is opposite to the first plane surface 96. A first plane surface 97 of the output end portion 95 is inclined to the second plane surface 92 which is opposite to the first plane surface 97. Further, as shown in FIG. 14, a first curved surface 98 of the output end portion 95 is inclined to a second curved surface 93 which is opposite to the first curved surface 98. A first curved surface 99 of the output end portion 95 is inclined to a second curved surface 94 which is opposite to the first curved surface 99. The first curved surfaces 98, 99 are formed in such a way as to be along an imaginary conical surface whose center is the axial center AX1.

Even in a case where the inclined surfaces are formed at the output end portion 95 in this manner, when each of a first clearance to a fourth clearance 101, 102, 103, 104 is made larger from one side to the other side in the axial direction, the same effects as in the first embodiment can be produced.

Modifications of the above embodiments will be described. In a modification, an outer wall surface of the output end portion may not only be constructed of a pair of first plane surfaces and a pair of curved surfaces but also be constructed of a pair of first plane surfaces and one or a plurality of other plane surfaces. In short, the outer wall surface of the output end portion needs only to have a pair of first plane surfaces. In another modification, a pair of first plane surfaces are not necessarily parallel to each other. In still another modification, each of the first clearance to the fourth clearance is not necessarily made larger from a suction hole side to a discharge hole side in the axial direction in a state where the rotary shaft and the impeller are concentric with each other. In still another modification, an edge portion between a plane surface and a curved surface, or an edge portion between a plane surface and a plane surface, of the outer wall surface of the output end portion may be formed in a round shape. The present disclosure is not limited to the embodiments described above but can be put into practice in various modes within a scope not departing from the gist of the present disclosure.

While the present disclosure has been described with reference to embodiments thereof, it is to be understood that the disclosure is not limited to the embodiments and constructions. The present disclosure is intended to cover various modification and equivalent arrangements. In addition, the various combinations and configurations, other combinations and configurations, including more, less or only a single element, are also within the spirit and scope of the present disclosure.

The invention claimed is:

1. A fuel pump comprising:

a motor;

an impeller that includes a fitting hole fitted to an output end portion of a rotary shaft of the motor; and a case that includes:

a pump chamber that receives the impeller;

a suction hole that passes through from the pump chamber to one side in an axial direction of the rotary shaft; and a discharge hole that passes through from the pump chamber to the other side in the axial direction, wherein:

an outer wall surface of the output end portion includes a pair of first plane surfaces which are formed at different positions in a circumferential direction of the output end portion;

an inner wall surface of the fitting hole includes a pair of second plane surfaces which are formed at different positions in the circumferential direction; and a clearance between one of the pair of first plane surfaces and one of the pair of second plane surfaces is made larger from one side toward the other side in the axial direction in a state that the rotary shaft and the impeller are concentric with each other.

2. The fuel pump according to claim 1, wherein a clearance between the other one of the pair of first plane surfaces and the other one of the pair of second plane surfaces is made larger from the one side toward the other side in the axial direction in the state that the rotary shaft and the impeller are concentric with each other.

3. The fuel pump according to claim 2, wherein:

provided that:

the clearance between the one of the pair of first plane surfaces and the one of the pair of second plane surfaces is referred to as a first clearance; and the clearance between the other one of the pair of first plane surfaces and the other one of the pair of second plane surfaces is referred to as a second clearance, an expression: $(S12-S11)/L1 \geq 0.0055$ is satisfied, where:

in the state that the rotary shaft and the impeller are concentric with each other, S11 is an interval of an end of the first clearance on the one side in the axial direction;

S12 is an interval of an end of the first clearance on the other side in the axial direction; and L1 is a length of the first clearance in the axial direction; and an expression: $(S22-S21)/L2 \geq 0.0055$ is satisfied, where:

in the state that the rotary shaft and the impeller are concentric with each other, S21 is an interval of an end of the second clearance on the one side in the axial direction;

S22 is an interval of an end of the second clearance on the other side in the axial direction; and L2 is a length of the second clearance in the axial direction.

4. The fuel pump according to claim 1, wherein:

the outer wall surface of the output end portion further includes a pair of first curved surfaces, each of which is located between the one of the pair of first plane surfaces and the other one of the pair of first plane surfaces in the circumferential direction and projects radially outward;

the inner wall surface of the fitting hole further includes a pair of second curved surfaces, each of which is located between the one of the pair of second plane surfaces and the other one of the pair of second plane surfaces in the circumferential direction and is recessed radially outward; and a clearance between one of the pair of first curved surfaces and one of the pair of second curved surfaces is made larger from the one side toward the other side in the axial direction in the state that the rotary shaft and the impeller are concentric with each other.

5. The fuel pump according to claim 4, wherein a clearance between the other one of the pair of first curved surfaces and the other one of the pair of second curved surfaces is made larger from the one side toward the other side in the axial direction in the state that the rotary shaft and the impeller are concentric with each other.

6. The fuel pump according to claim 1, wherein both of the pair of first plane surfaces are parallel to an axial center of the rotary shaft.

7. The fuel pump according to claim 1, wherein:

the one side in the axial direction is the discharge hole-side with respect to the impeller; and the other side in the axial direction is the suction hole-side with respect to the impeller.

8. A fuel pump comprising:

a motor;

an impeller that includes a fitting hole fitted to an output end portion of a rotary shaft of the motor; and a case that includes:

a pump chamber that receives the impeller;

a suction hole that passes through from the pump chamber to one side in an axial direction of the rotary shaft; and a discharge hole that passes through from the pump chamber to the other side in the axial direction, wherein:

an outer wall surface of the output end portion includes:

a pair of first plane surfaces which are formed at different positions in a circumferential direction of the output end portion; and a pair of first curved surfaces, each of which is located between one of the pair of first plane surfaces and the other one of the pair of first plane surfaces in the circumferential direction and projects radially outward;

an inner wall surface of the fitting hole includes:

a pair of second plane surfaces which are formed at different positions in the circumferential direction; and a pair of second curved surfaces, each of which is located between one of the pair of second plane surfaces and the other one of the pair of second plane surfaces in the circumferential direction and is recessed radially outward; and a clearance between the one of the pair of first plane surfaces and the one of the pair of second plane surfaces is made larger from the one side toward the other side in the axial direction in a state that the rotary shaft and the impeller are concentric with each other.

9. The fuel pump according to claim 8, wherein a clearance between the other one of the pair of first plane surfaces and the other one of the pair of second plane surfaces is made larger from the one side toward the other side in the axial direction in the state that the rotary shaft and the impeller are concentric with each other.

10. The fuel pump according to claim 8, wherein both of the pair of first plane surfaces are parallel to an axial center of the rotary shaft.

11. The fuel pump according to claim 8, wherein:

the one side in the axial direction is the discharge hole-side with respect to the impeller; and the other side in the axial direction is the suction hole-side with respect to the impeller.

* * * * *